US006673218B2

(12) United States Patent
Yamamoto

(10) Patent No.: US 6,673,218 B2
(45) Date of Patent: Jan. 6, 2004

(54) CATHODE CARTRIDGE FOR ELECTROPATING TESTER

(75) Inventor: Wataru Yamamoto, Tokyo (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 0 days.

(21) Appl. No.: 10/260,614

(22) Filed: Oct. 1, 2002

(65) Prior Publication Data

US 2003/0192782 A1 Oct. 16, 2003

(30) Foreign Application Priority Data

Apr. 12, 2002 (JP) ..... 2002-110402

(51) Int. Cl.[7] ..... G01N 27/26; C25B 9/02

(52) U.S. Cl. ..... 204/286.1; 204/288.3; 204/297.01; 204/297.06; 204/297.1; 204/297.11; 204/297.14; 204/400; 204/434

(58) Field of Search ..... 204/286.1, 288.3, 204/297.01, 297.06, 297.1, 297.11, 297.14, 400, 434

(56) References Cited

U.S. PATENT DOCUMENTS 3,445,369 A * 5/1969 Porter et al.
3,763,025 A * 10/1973 Chand
4,182,666 A * 1/1980 Dickinson et al.
6,569,302 B1 * 5/2003 Steinrucke
2002/0008026 A1 1/2002 Yamamoto
2002/0040849 A1 4/2002 Yamamoto

FOREIGN PATENT DOCUMENTS

| | | |
|---|---|---|
| EP | 1 164 209 | 12/2001 |
| EP | 1 195 454 | 4/2002 |
| JP | 2001-335996 | 12/2001 |
| JP | 2002-115092 | 4/2002 |

* cited by examiner

*Primary Examiner*—T. Tung
(74) *Attorney, Agent, or Firm*—Sughrue Mion, PLLC

(57) ABSTRACT

A cathode cartridge (N) for an electroplating tester includes a cathode conductor (10) that conducts electricity to a surface (Wa) to be plated of a silicon wafer (W) as an object to be plated, a first insulator (20) that covers a front side of the silicon wafer (W) and holds the cathode conductor (10), and a second insulator (30) that covers a back side of the silicon wafer (W) and holds the silicon wafer (W). Negative portions other than the surface (Wa) to be plated of the silicon wafer (W) are insulated from plating solution with a first O-ring (22) fitted in the first insulator (20) and a second O-ring (32) fitted in the second insulator (30).

6 Claims, 13 Drawing Sheets

CATHODE CARTRIDGE FOR ELECTROPATING TESTER

BACKGROUND OF THE INVENTION

This invention relates generally to cathode cartridges for electroplating testers, and more particularly to a cathode cartridge for an electroplating tester, with which silicon wafers, glass substrates, ceramic substrates, or the like coated with a metal layer can be plated precisely.

In recent years, the plating technique has extensively been used in various fields of technology, such as one which lends itself to wiring for semiconductor chips. In the field of semiconductor-related industries, fine-pitch wiring within and on the semiconductor chips is required for realizing high-density packaging and high performance of an electronic circuit. Among wiring methods that prevail recently, the so-called Damascene process is widely adopted. The Damascene process is a method in which a conductive material is embedded through a plating process into a channeled pattern of wiring formed through a dry etching process after forming an interlayer insulating film.

One of the latest applications of the plating technique, called LIGA (abbreviation of the German phrase, Lithographie Galvanoformung Abformung), is directed to manufacture of parts of micromachines. The LIGA forms a mold of an acrylic resin using X-rays, and thick metal plating is deposited in the mold, so that very small metal parts are molded.

To implement the plating techniques as exemplified above, the metal plating should be uniformly deposited on the channeled pattern formed in an object to be plated. In this respect, the applicant for the instant application has proposed in Japanese Patent Application No. 2000-152342 (published under JP 2001-335996 A; corresponding to U.S. Ser. 2002/0008026 A1, and EP 1164209 A2) an electroplating tester and a cathode cartridge for use with the electroplating tester, with which a uniform layer of plating can be formed on a surface to be plated of an object to be plated.

According to the disclosure, a cathode cartridge 70 for use with electroplating testers, as shown in FIG. 12, includes a tabular cathode conductor 71, a front insulator 72, a rear insulator 73, and an elastic thin board 74. The tabular cathode conductor 71 includes an opening having the same shape as a surface Wa to be plated of an object W to be plated as a negative, a plurality of protrusions 71*a* in contact with a rim of the surface Wa to be plated, and an exposed portion which is not to be immersed in plating solution and thus connectible with a direct-current power supply. The front insulator 72 includes an opening having the same shape as the surface Wa to be plated, and covers the front side of the cathode conductor 71. The rear insulator 73 is a tabular body including a groove 73*a* into which the object W to be plated is fitted, and a groove 73*b* into which the cathode conductor 71 is fitted. The elastic thin board 74 is to be sandwiched between the object W to be plated and the rear insulator 73.

However, the conventional technique as disclosed in JP 2001-335996 A would disadvantageously allow plating solution L to reach a portion 71*b*, etc. other than the rim Wb of the surface Wa to be plated of the object W to be plated, a side surface Wc of the object W to be plated, and the protrusions 71*a* of the cathode conductor 71, as shown in FIG. 13. Accordingly, one of the problems associated with the conventional cathode cartridge for use with electroplating testers is that negative portions other than the surface Wa to be plated of the object W to be plated could be immersed in the plating solution.

The state of the art is at the point where wiring on or within semiconductor chips is constituted of a fine wire measuring 0.5 $\mu$m or smaller in diameter, and thus requires a very high degree of plating precision. However, if negative portions other than the surface Wa to be plated of the object W to be plated were immersed in the plating solution, an error could occur in areas of the surface to be plated, with the result that required plating precision would not be obtained. Consequently, in order to achieve a high degree of plating precision, the negative portions other than the surface Wa to be plated of the object W to be plated need be insulated from the plating solution.

The present invention is made to eliminate the above-described disadvantages.

SUMMARY OF THE INVENTION

It is an exemplified general object of the present invention to provide a cathode cartridge for an electroplating tester capable of insulating negative portions other than a surface to be plated of an object to be plated.

A cathode cartridge for an electroplating tester according to the present invention comprises: a tabular cathode conductor that includes an opening having the same contour as a surface to be plated of an object to be plated as a negative, a plurality of protrusions in contact with a rim of the surface to be plated, and a power-supply connection portion connectible with a power supply at a portion thereof which is not to be immersed in plating solution; a tabular first insulator that covers one surface to be plated of the object to be plated and includes an opening having the same contour as the surface to be plated, a first sealant fit-in groove which is formed along a circumferential edge of the opening and into which a first sealant is fitted, a cathode conductor fit-in groove which is formed at an outside of the first sealant fit-in groove and into which the cathode conductor is fitted, and a power-supply connection portion slot which is formed contiguously with the cathode conductor fit-in groove and into which the power-supply connection portion is fitted; and a tabular second insulator that covers the other surface reverse to the surface to be plated of the object to be plated and includes an object-to-be-plated fit-in groove into which the object to be plated is fitted, a second sealant fit-in groove which is located at an outside of the object-to-be-plated fit-in groove so as to come in a position outside an inlet of the power-supply connection portion slot when the second insulator is combined with the first insulator and into which the second sealant is fitted. The first insulator and the second insulator are combined together so that the first insulator and the second insulator sandwich the object to be plated and the cathode conductor.

The above construction allows the first sealant to be brought into contact with the rim of the surface to be plated of the object to be plated, and the second sealant to be brought into contact with the surface of the first insulator at an outside of a position where the object to be plated is located, when the first insulator and the second insulator are combined together, thus serving to insulate the rim and side of the surface to be plated of the object to be plated from the plating solution. Moreover, an inlet of the power-supply connection portion slot is properly positioned between the first sealant and the second sealant when the first insulator and the second insulator are combined together; thus, portions other than the protrusions of the cathode conductor can be insulated from the plating solution.

The first insulator may further include a second insulator fit-in groove which is formed at an outside of the cathode conductor fit-in groove and into which the second insulator is fitted when the first insulator and the second insulator are combined together, so that the opening of the first insulator and the surface to be plated of the object to be plated fitted in the object-to-be-plated fit-in groove of the second insulator may be appropriately aligned with ease. To be more specific, the opening of the first insulator and the surface to be plated of the object to be plated fitted in the object-to-be-plated fit-in groove of the second insulator can be positioned directly opposite to each other, when the first insulator and the second insulator are combined together.

The first insulator and the second insulator may be combined together with ease by fastening up with screws made of plastic. The first insulator and the second insulator may be combined using any means other than the screws, such as a clip.

Further, a laminar elastic body covering the surface reverse to the surface to be plated of the object to be plated may be fitted into the object-to-be-plated fit-in groove of the second insulator. When the first insulator and the second insulator are combined together, the object to be plated fitted in the object-to-be-plated fit-in groove are pushed toward the first sealant fitted in the first sealant fit-in groove of the first insulator. As a result, the rim of the surface to be plated of the object to be plated can be kept in intimate contact with the first sealant. Thus-achieved intimate contact of the rim of the surface to be plated of the object to be plated with the first sealant can contribute to more secure insulation of the rim and side of the surface to be plated of the object to be plated from plating solution.

The laminar elastic body also serves to fill up a gap between the object to be plated and the object-to-be-plated fit-in groove. To be more specific, the elastic body having the same thickness as the gap between the object to be plated and the object-to-be-plated fit-in groove may be fitted into the object-to-be-plated fit-in groove of the second insulator; thereby the gap between the object to be plated and the object-to-be-plated fit-in groove can be closed up. No-gap contact between the object to be plated and the object-to-be-plated fit-in groove as thus achieved allows the object to be plated fitted in the object-to-be-plated fit-in groove to be securely pushed toward the first sealant fit-in groove fitted in the first sealant fit-in groove.

Other objects and further features of the present invention will become readily apparent from the following description of preferred embodiments with reference to accompanying drawings.

DETAILED DESCRIPTION OF THE PREFERRED EMBODIMENTS

A detailed description of the preferred embodiments of the present invention will be given hereinafter with reference to the accompanying drawings. It is to be understood that the following description of the embodiments is based upon the premise that a silicon wafer having one surface thereof coated with a metal layer is used as an object to be plated and plating is applied to the metal layer.

Figure 1:
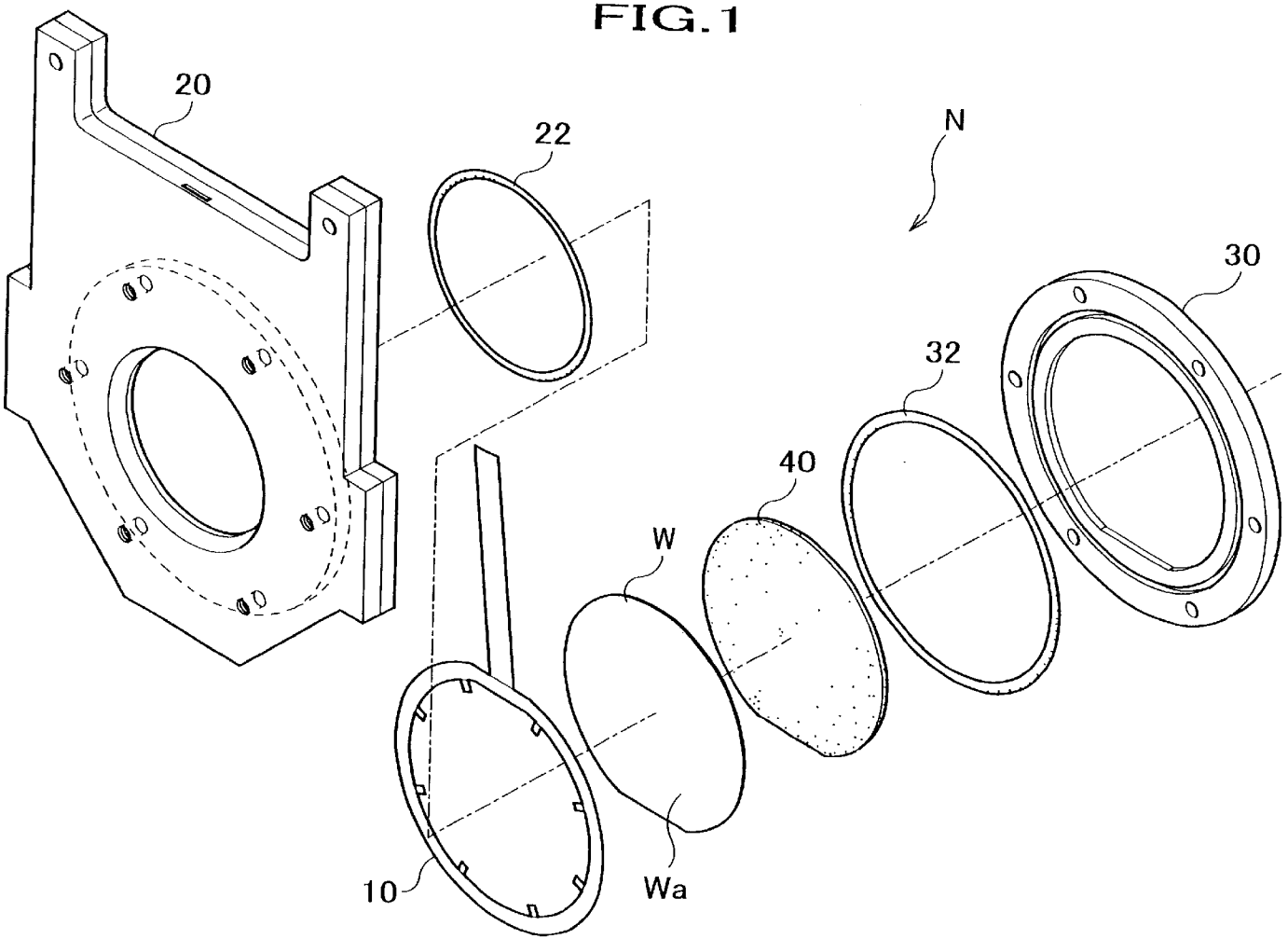
FIG. 1 is an exploded perspective view of a cathode cartridge for an electroplating tester according to the present invention.

A description will now be given of a construction of a cathode cartridge for an electroplating tester according to the present invention (hereinafter referred to simply as "cathode cartridge"). FIG. 1 is an exploded perspective view of the cathode cartridge.

As shown in FIG. 1, the cathode cartridge N includes a cathode conductor 10 that conducts electricity through a surface Wa to be plated of a silicon wafer W as an object to be plated, a first insulator 20 that covers the surface Wa to be plated (hereinafter referred to as "front side") of the silicon wafer W to hold the cathode conductor 10, and a second insulator 30 that covers the reverse side of the surface Wa to be plated (hereinafter referred to as "back side") of the silicon wafer W to hold the silicon wafer W. The silicon wafer W is laminar, and a laminar elastic body 40 is applied to the back side of the silicon wafer W. Each element will now be described in detail.

Figure 2A:
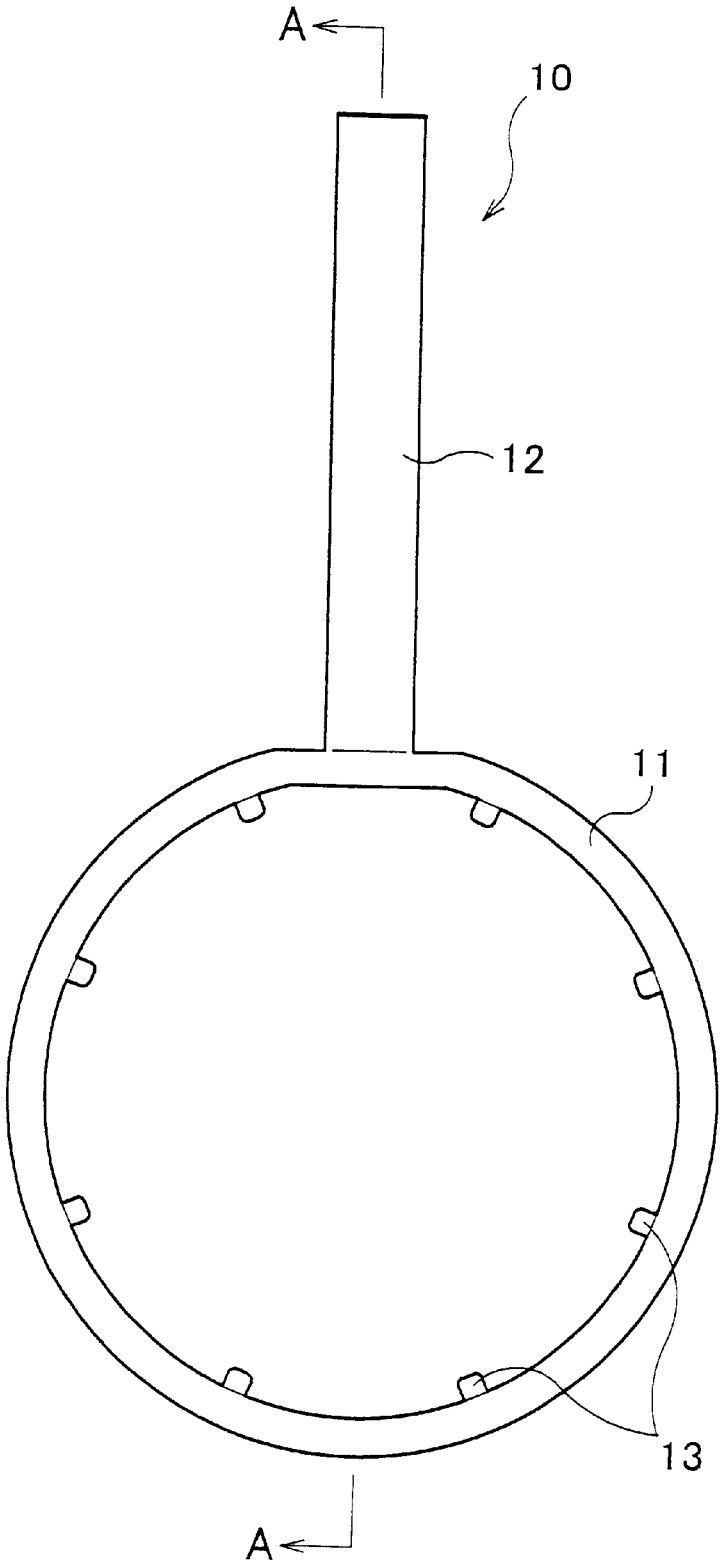
FIG. 2A is a front elevation of a cathode conductor as viewed from a second insulator.
Figure 2B:
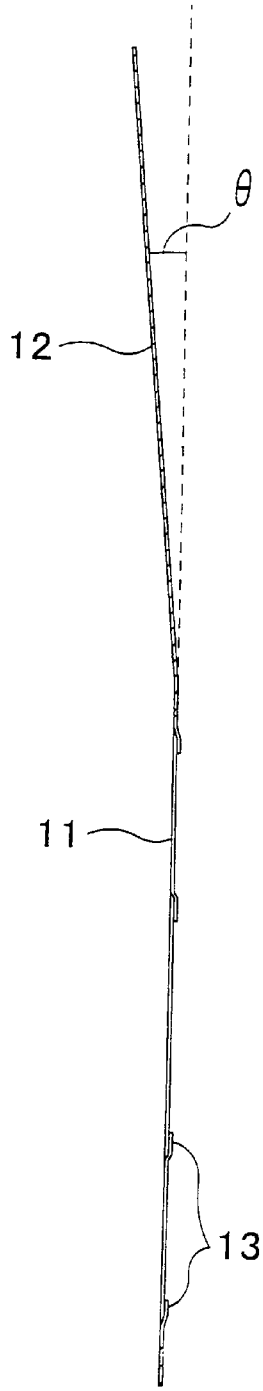
FIG. 2B is a cross section of the cathode conductor taken along line A—A of FIG. 2A.

The cathode conductor 10 is, for example, formed of conductive materials such as copper and stainless steel. The cathode conductor 10 includes an opening 11 having the same contour as the surface Wa to be plated of the silicon wafer W, and a power-supply connection portion 12 shaped like a rectangular slip extending oblongly from the opening 11, as shown in FIG. 2A. The power-supply connection portion 12 tilts at a predetermined angle θ so that it may be inserted into a power-supply connection portion slot 25 provided in the first insulator 20 (see FIG. 2B). In this embodiment, the tilt angle θ is set at 5 degrees. The power-supply connection portion 12 inserted into the power-supply connection portion slot 25 of the first insulator 20, which is partially not to be immersed in the plating solution, is connected with an anode of the power supply at the portion that is not to be immersed in the plating solution. Along the circumferential edge of the opening 11, more than one protrusion 13 to be brought into contact with the rim of the surface Wa to be plated of the silicon wafer W is provided on spots spaced at predetermined intervals.

Figure 3:
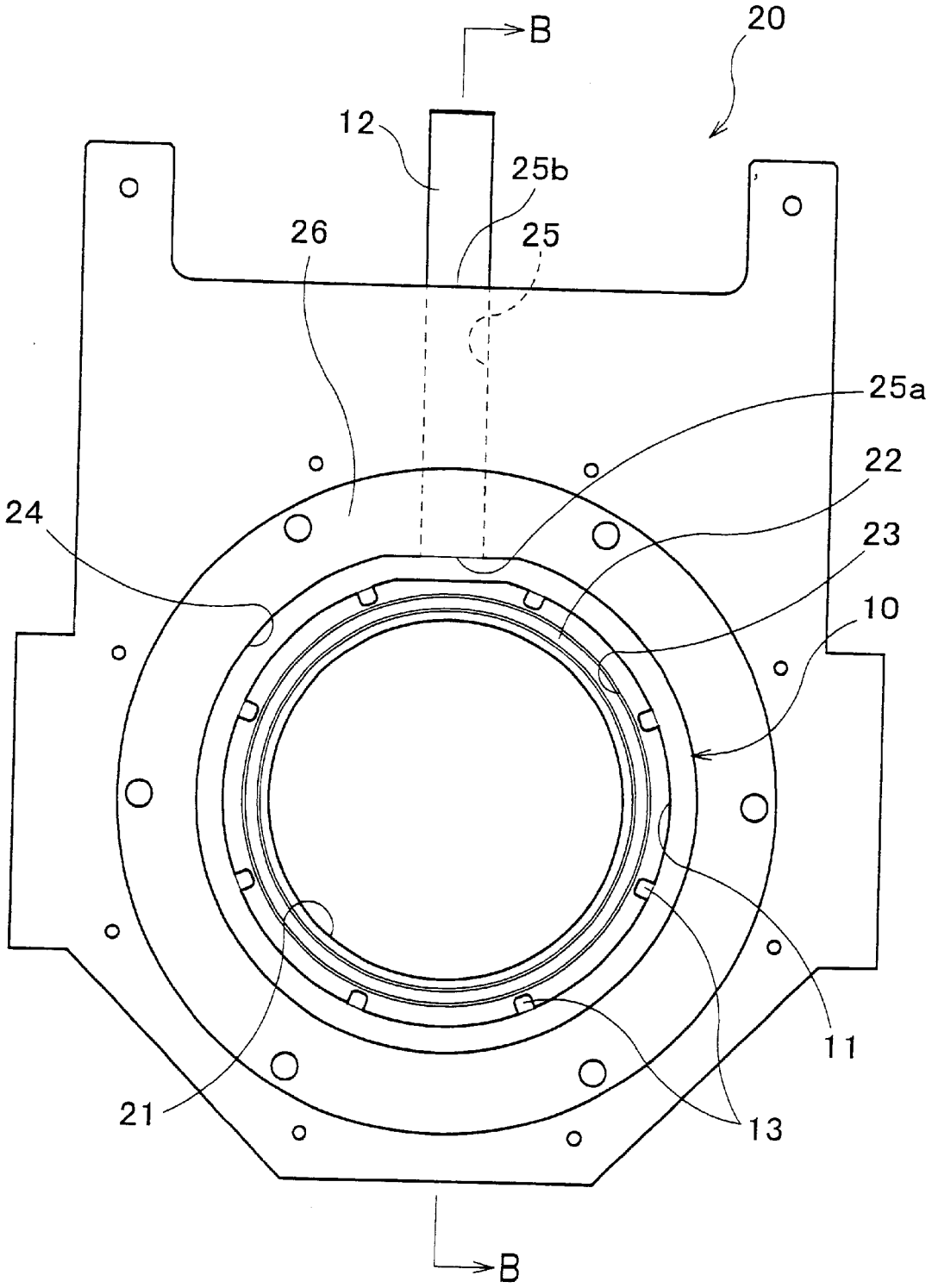
FIG. 3 is a front elevation of a first insulator as viewed from the second insulator.
Figure 4:
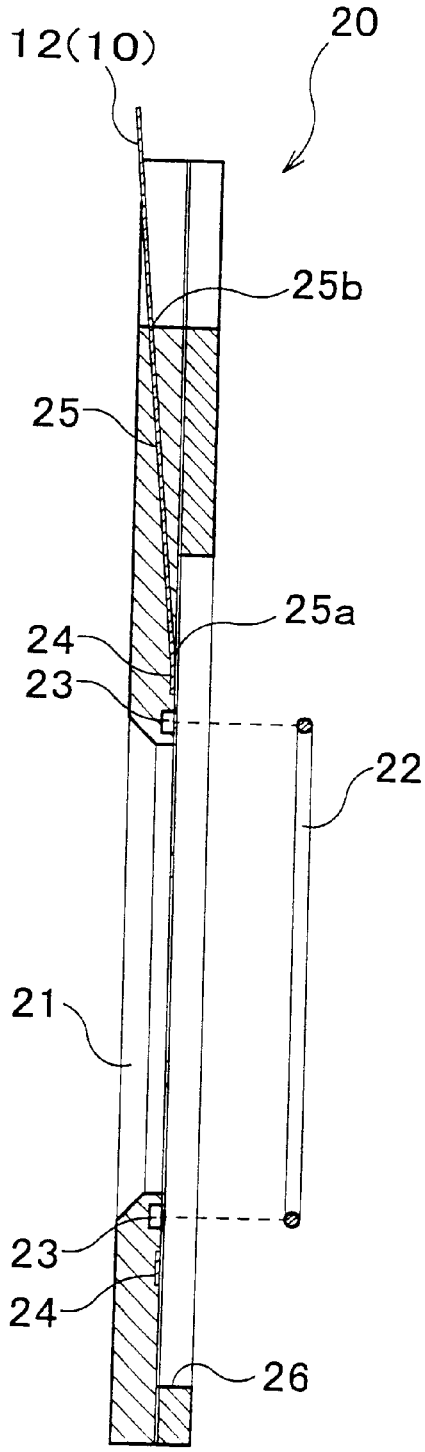
FIG. 4 is a cross section of the first insulator taken along line B—B of FIG. 3.

The first insulator 20 is, for example, formed of an acrylic board or other insulating material. As shown in FIGS. 3 and 4, the first insulator 20 includes an opening 21 having the same contour as the surface Wa to be plated of the silicon wafer W. On one surface of the first insulator 20, a first O-ring fit-in groove 23 into which a first O-ring 22 is fitted is formed along a line adjacent to the circumferential edge of the opening 21.

Figure 8:
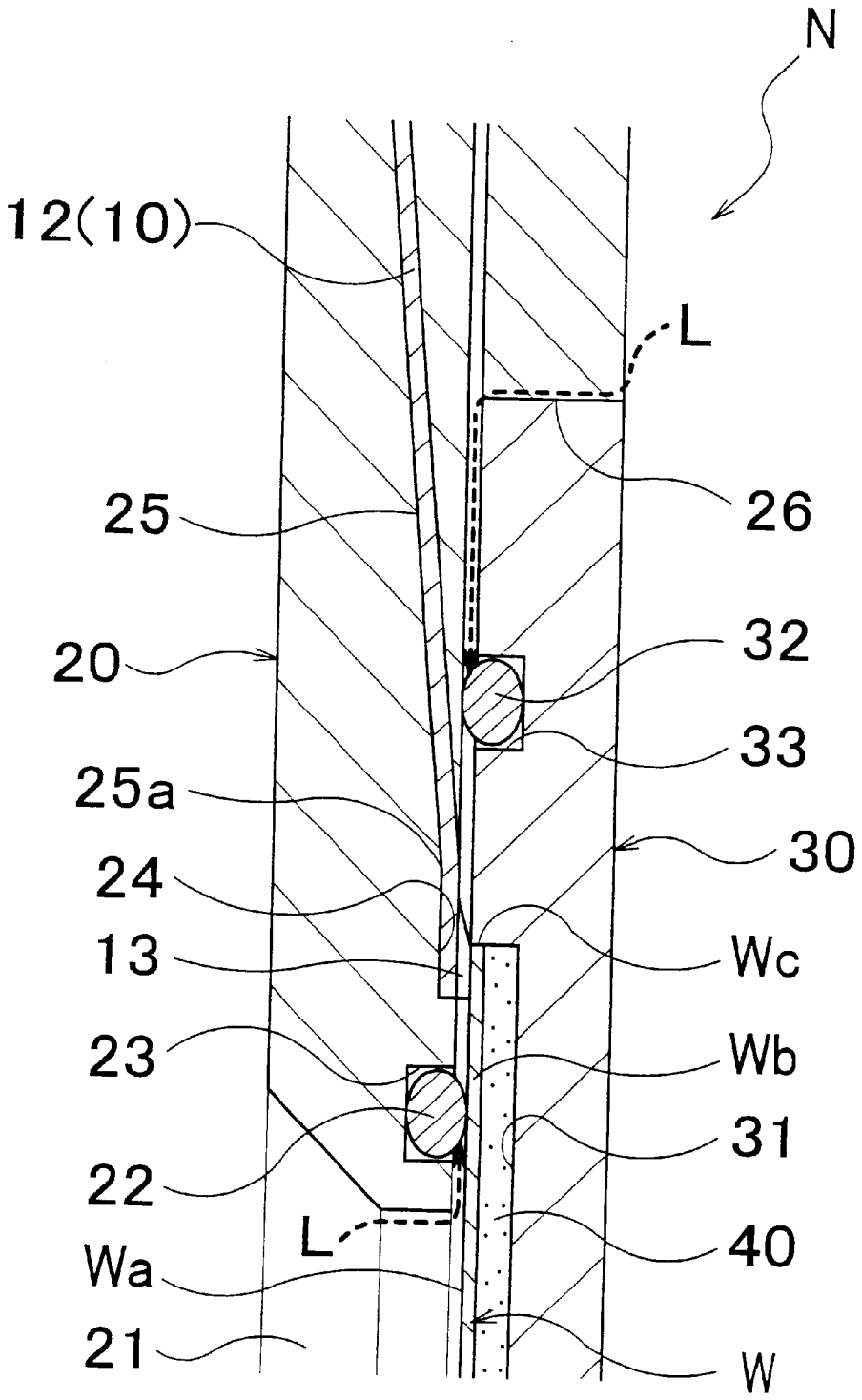
FIG. 8 is a magnified view of a portion enclosed with a broken line in FIG. 7B.

The first O-ring 22 is brought into contact with the rim Wb of the surface Wa to be plated of the silicon wafer W when the first insulator 20 is combined with the second insulator 30, and thereby the rim Wb and a side Wc of the surface Wa to be plated are insulated from the plating solution L (see FIG. 8). The above "first O-ring 22" corresponds to "first sealant" in claims as described in the summary of the invention. It is to be understood that the sealant is not limited to O-ring as exemplified in the present embodiment.

At an outside of the O-ring fit-in groove 23 is formed a cathode conductor fit-in groove 24 into which the cathode conductor 10 is fitted, and a power-supply connection portion slot 25 into which the power-supply connection portion 12 of the cathode conductor 10 is fitted is formed contiguously with the cathode conductor fit-in groove 24. At an outside of the cathode conductor fit-in groove 24 is formed a second insulator fit-in groove 26 into which the second insulator 30 is fitted when the first insulator 20 is combined with the second insulator 30. The construction in which the second insulator 30 is fitted into the second insulator fit-in groove 26 makes it possible to combine the first insulator 20 and the second insulator 30 together with the opening 21 of the first insulator 20 being directly opposite to the surface Wa to be plated of the silicon wafer W that is fitted in an object-to-be-plated fit-in groove 31 provided in the second insulator 30.

The power-supply connection portion slot 25 is formed as shown in FIG. 4, and tilts from the surface on which the cathode conductor fit-in groove 24 is formed (right side in the drawing) to the other surface (left side in the drawing) at a predetermined angle θ. In this embodiment, the tilt angle θ is set at 5 degrees. An inlet 25*a* of the power-supply connection portion slot 25 is contiguous with the cathode conductor fit-in groove 24, and an outlet 25*b* thereof is provided at an upper position on the other surface of the insulator 20.

Figure 5:
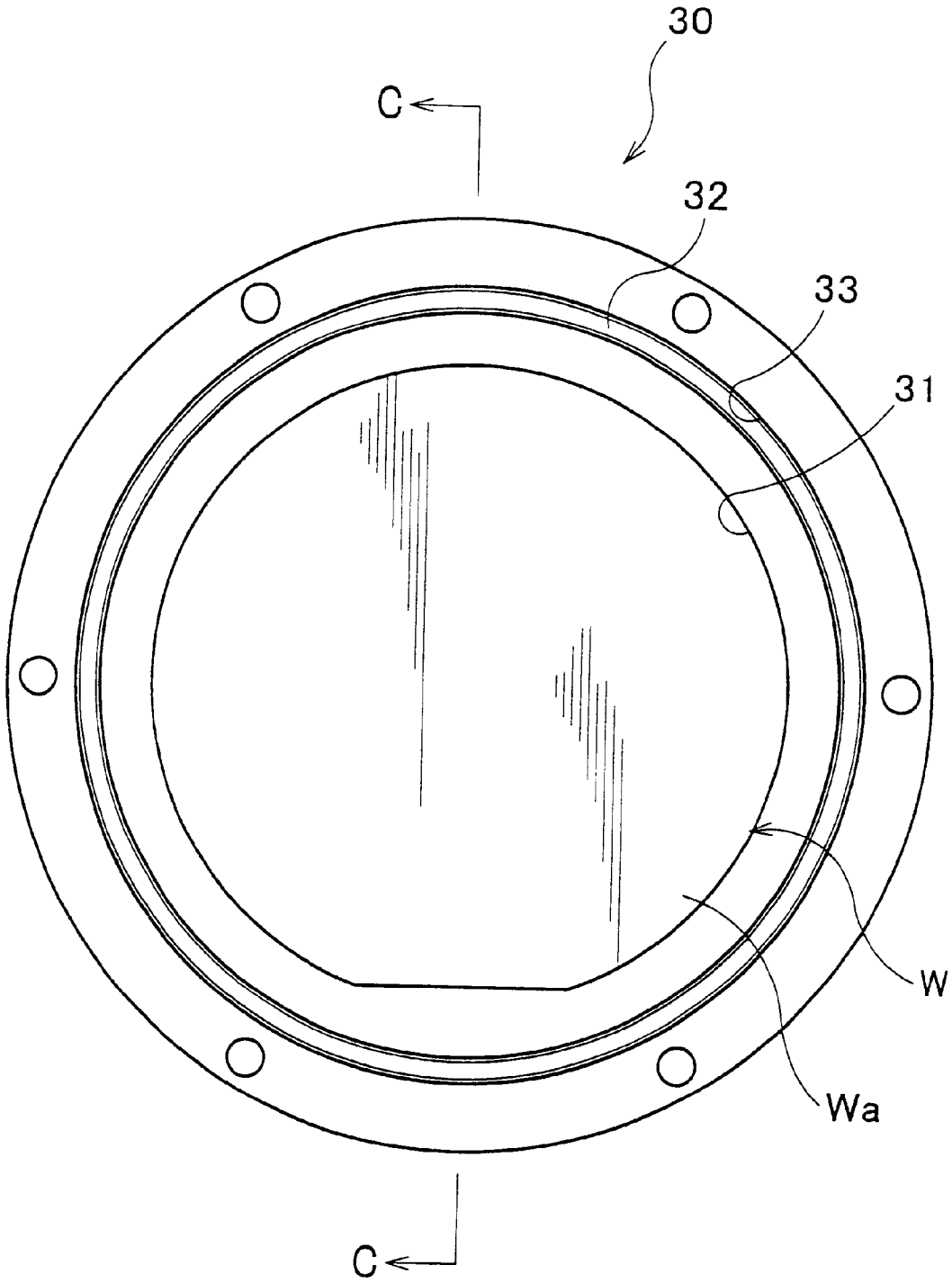
FIG. 5 is a front elevation of the second insulator as viewed from the first insulator.
Figure 6:
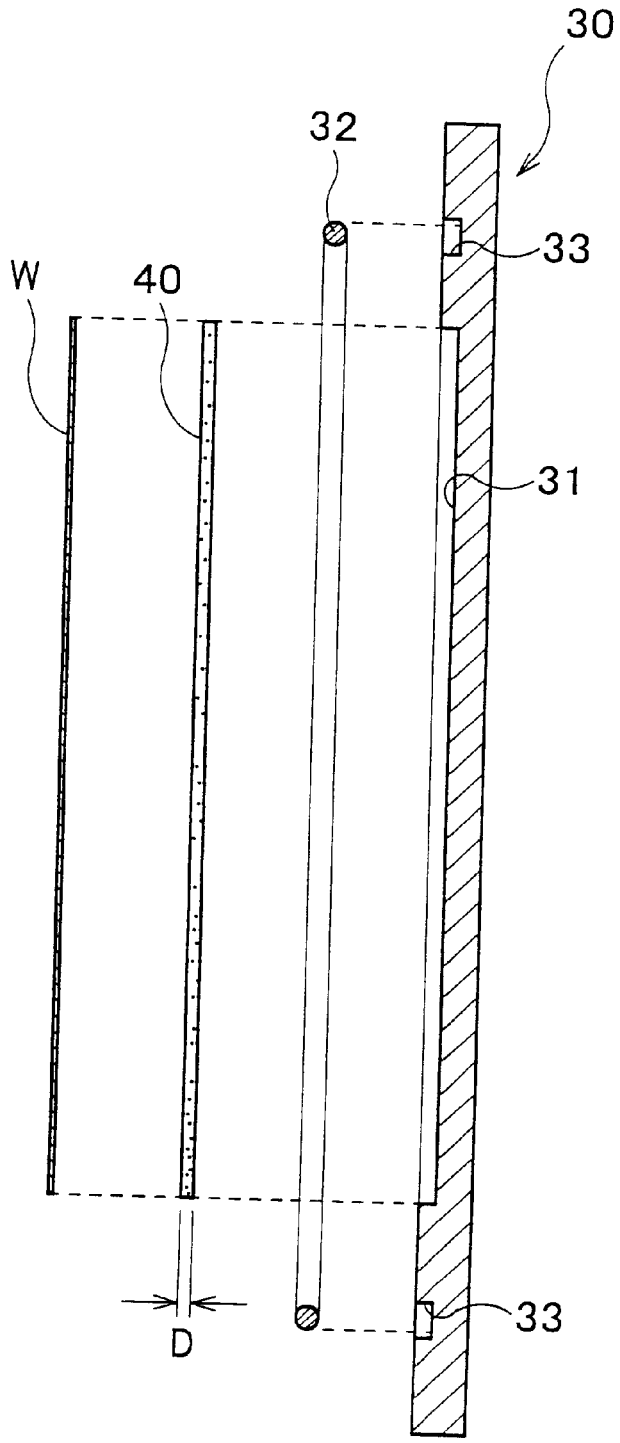
FIG. 6 is a cross section of the second insulator taken along line C—C of FIG. 5.

The second insulator 30 is, for example, formed of an acrylic board or other insulating material. On one surface of the second insulator 30, as shown in FIGS. 5 and 6, is formed an object-to-be-plated fit-in groove 31 into which the silicon wafer W is fitted. Further formed at an outside of the object-to-be-plated fit-in groove 31 is a second O-ring fit-in groove 33 into which a second O-ring 32 is fitted. The second O-ring fit-in groove 33 is so formed as to come in a position outside the inlet 25*a* of the, power-supply connection portion slot 25 of the first insulator 20 when the first insulator and the second insulator are combined together (see FIG. 8).

The second O-ring 32 is brought into contact with the surface of the first insulator 20 at an outside of a position where the silicon wafer W is located when the first insulator 20 and the second insulator 30 are combined together, and thereby the rim Wb and side Wc of the surface Wa to be plated of the silicon wafer W are insulated from the plating solution L (see FIG. 8). The above "second O-ring 32" corresponds to the "second sealant" in claims as described in the summary of the invention. It is to be understood that the sealant is not limited to O-ring as exemplified in the present embodiment.

The elastic body 40 is, for example, formed of rubber or other elastic materials. The elastic body 40 is fitted into the object-to-be-plated fit-in groove 31 of the second insulator 30 in such a manner as to cover the back side of the silicon wafer W, as shown in FIGS. 1 and 6. The elastic body 40 serves, as shown in FIG. 8, to press the silicon wafer W fitted in the object-to-be-plated fit-in groove 31 of the second insulator 30 to the first O-ring 22 fitted in the first O-ring fit-in groove 23 of the first insulator 20, thus bringing the rim Wb of the surface Wa to be plated of the silicon wafer W into contact with the first O-ring 22. Consequently, the thus-established intimate contact between the rim Wb of the surface Wa to be plated of the silicon wafer W and the first O-ring 22 makes it possible to insulate the rim Wb and side Wc of the surface Wa to be plated of the silicon wafer W from the plating solution L more securely.

The elastic body 40 also serves to fill a gap between the silicon wafer W and the object-to-be-plated fit-in groove 31. More specifically, as shown in FIG. 6, assuming that the gap between the silicon wafer W and the object-to-be-plated fit-in groove 31 is D in thickness, the elastic body 40 having a thickness of W or greater may be fitted in the object-to-be-plated fit-in groove 31 so that the gap can be closed up between the silicon wafer W and the object-to-be-plated fit-in groove 31. By making up the gap D between the silicon wafer W and the object-to-be-plated fit-in groove 31, the silicon wafer W fitted in the object-to-be-plated fit-in groove 31 can be securely pushed toward the first O-ring 22 fitted in the first O-ring fit-in groove 23 of the first insulator 20 when the first insulator 20 and the second insulator 30 are combined together.

Figure 7A:
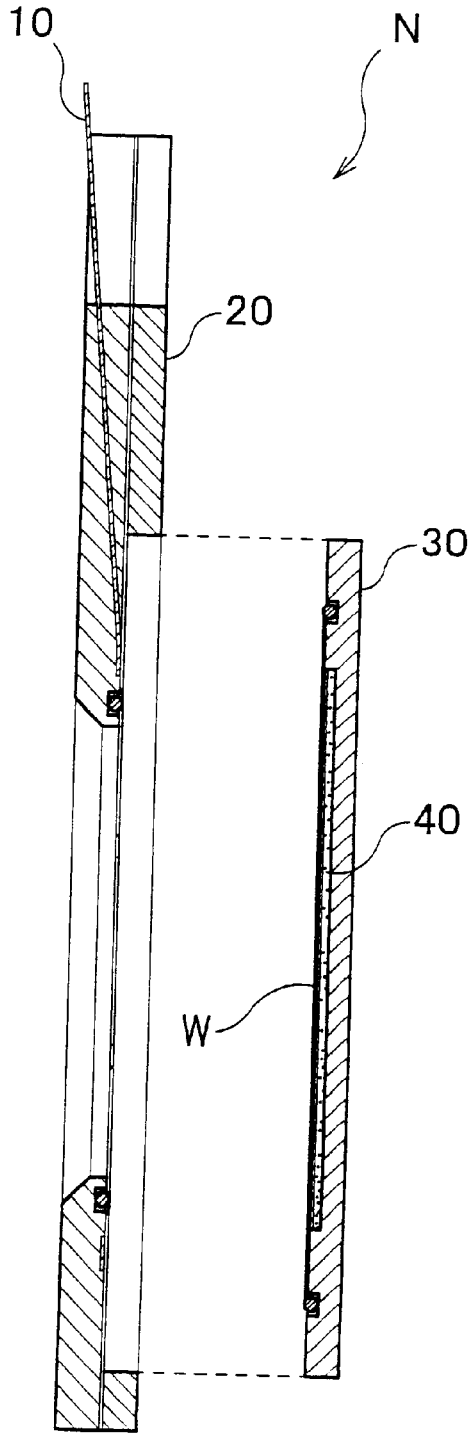
FIG. 7A is a cross-sectional view of the first insulator and the second insulator that will be combined together.
Figure 7B:
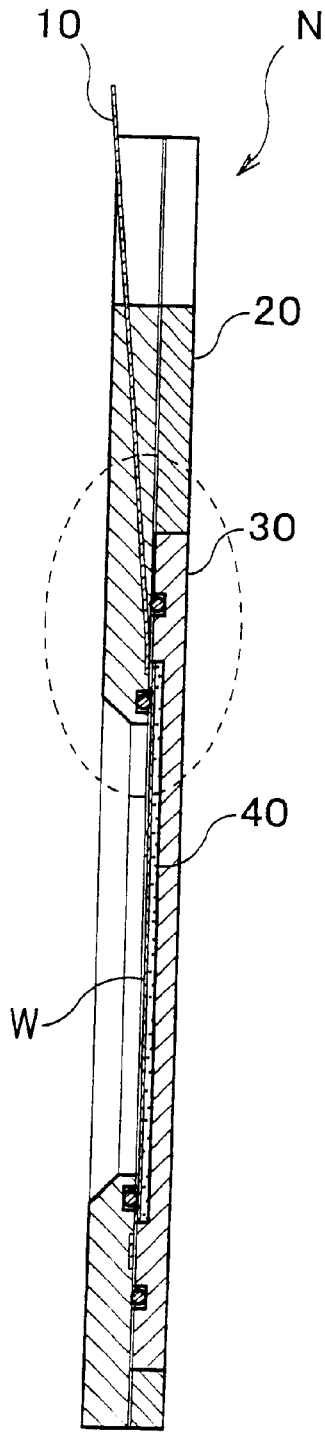
FIG. 7B is a cross-sectional view of the first insulator and the second insulator that has been combined together.

As shown in FIGS. 7A and 7B, the cathode cartridge N is arranged to have the first insulator 20 and the second insulator 30 combined together and fastened up with screws made of plastic (not shown), and to allow one surface of the first insulator 20 (right side in the drawing) and one surface of the second insulator 30 (left side in the drawing) to hold the silicon wafer W and the cathode conductor 10. The first insulator 20 and the second insulator 30 may be combined together using any means other than screws, for example, using a clip or the like.

As shown in the enlarged illustration of FIG. 8, the first O-ring 22 is in contact with the rim Wb of the surface Wa to be plated of the silicon wafer W, while the second O-ring 32 is in contact with a surface of the first insulator 20 at a location outside the object to be plated W. Thus, the rim Wb and side Wc of the surface Wa to be plated may be insulated from the plating solution L. In addition, the inlet 25*a* of the power-supply connection portion slot 25 formed in the first insulator 20 is disposed between the first O-ring 22 and the second O-ring 32; thereby, portions other than the protrusion 13 in the cathode conductor 10 may be insulated from the plating solution L.

Figure 9:
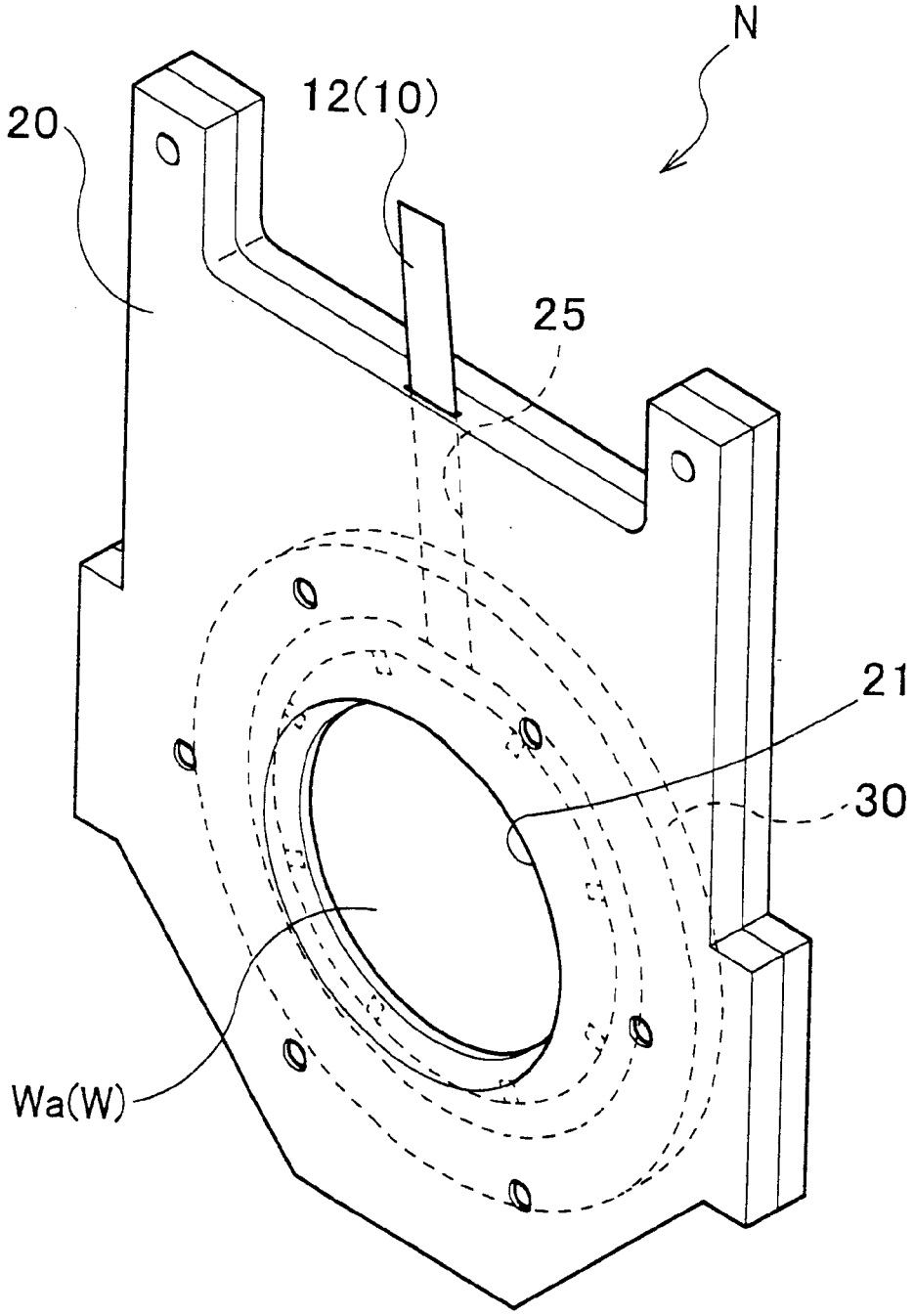
FIG. 9 is a perspective view of the cathode cartridge as viewed from the first insulator.

In the cathode cartridge N, which is constructed as discussed above, when the first insulator 20 and the second insulator 30 are combined together, as shown in FIG. 9, the surface Wa to be plated of the silicon wafer W is exposed from the opening 21 of the first insulator 20 as viewed from the first insulator 20. The power-supply connection portion 12 of the cathode conductor 10 passes through the power-supply connection portion slot 25, and projects from an upper position of the first insulator 20. The power-supply connection portion 12 that projects from the upper position of the first insulator 20 is connected at a portion that is not to be immersed in the plating solution with the anode of the power supply.

Figure 10:
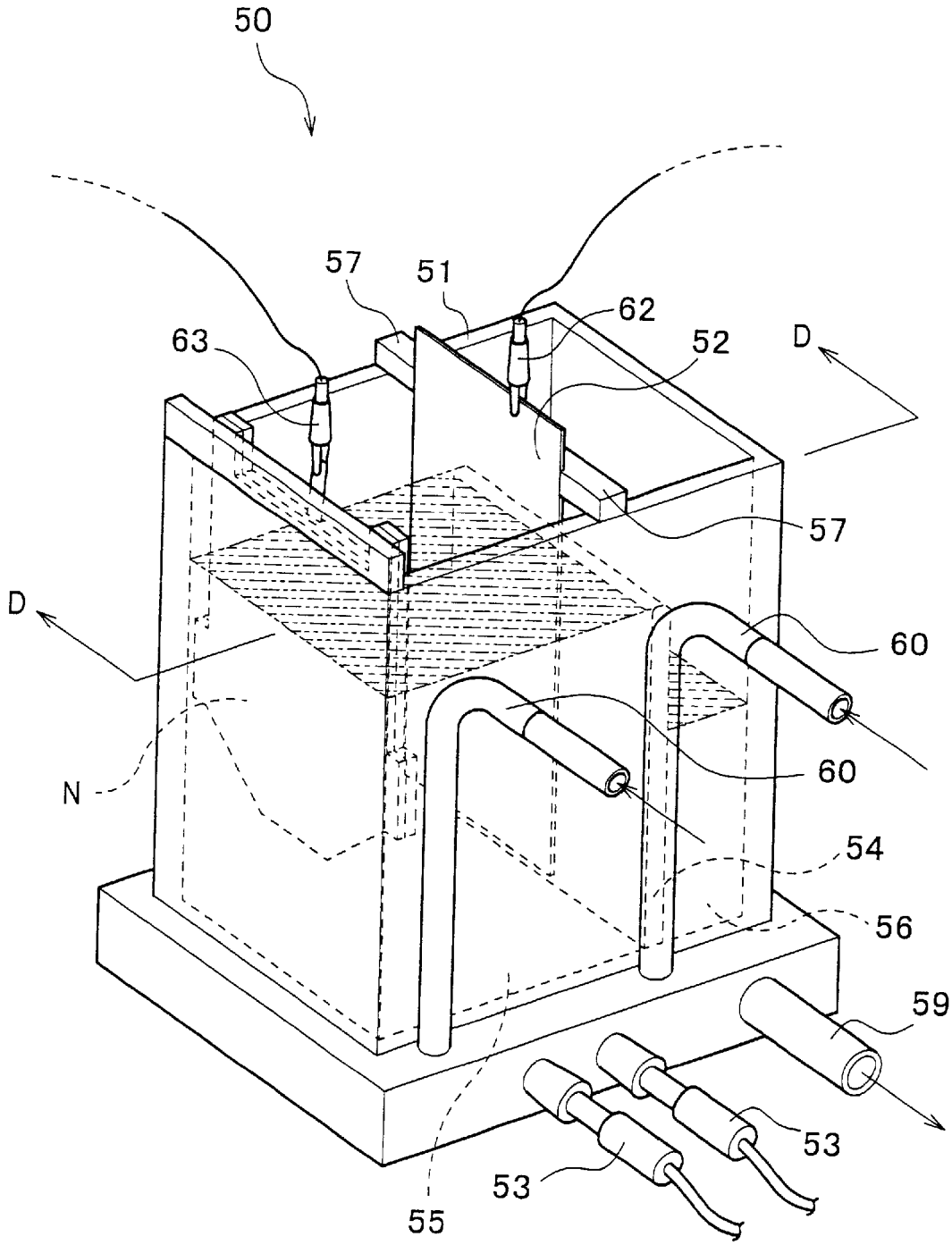
FIG. 10 is an external view, in perspective, of an electroplating tester.
Figure 11:
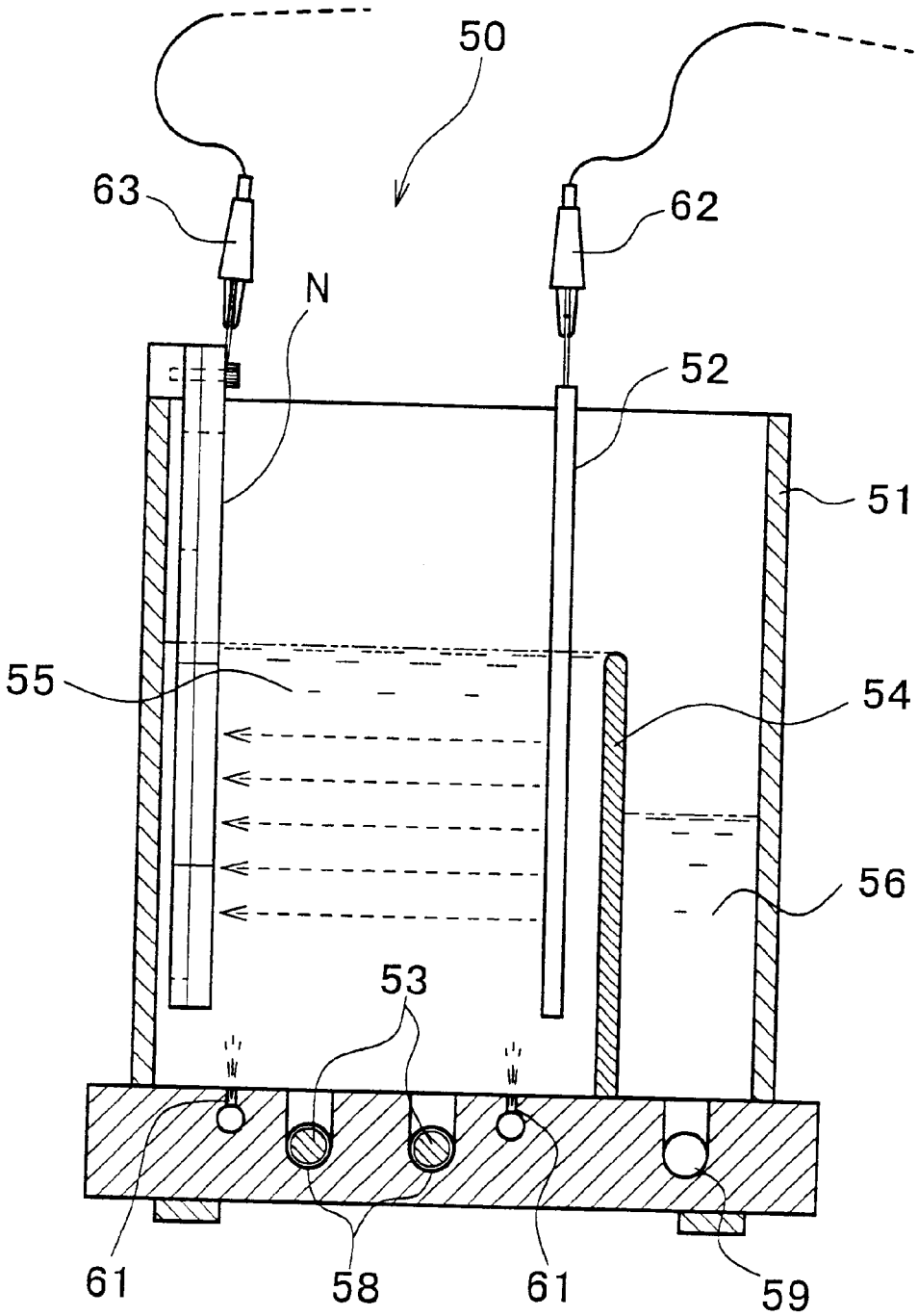
FIG. 11 is a cross section of the electroplating tester taken along line D—D of FIG. 10.
Figure 12:
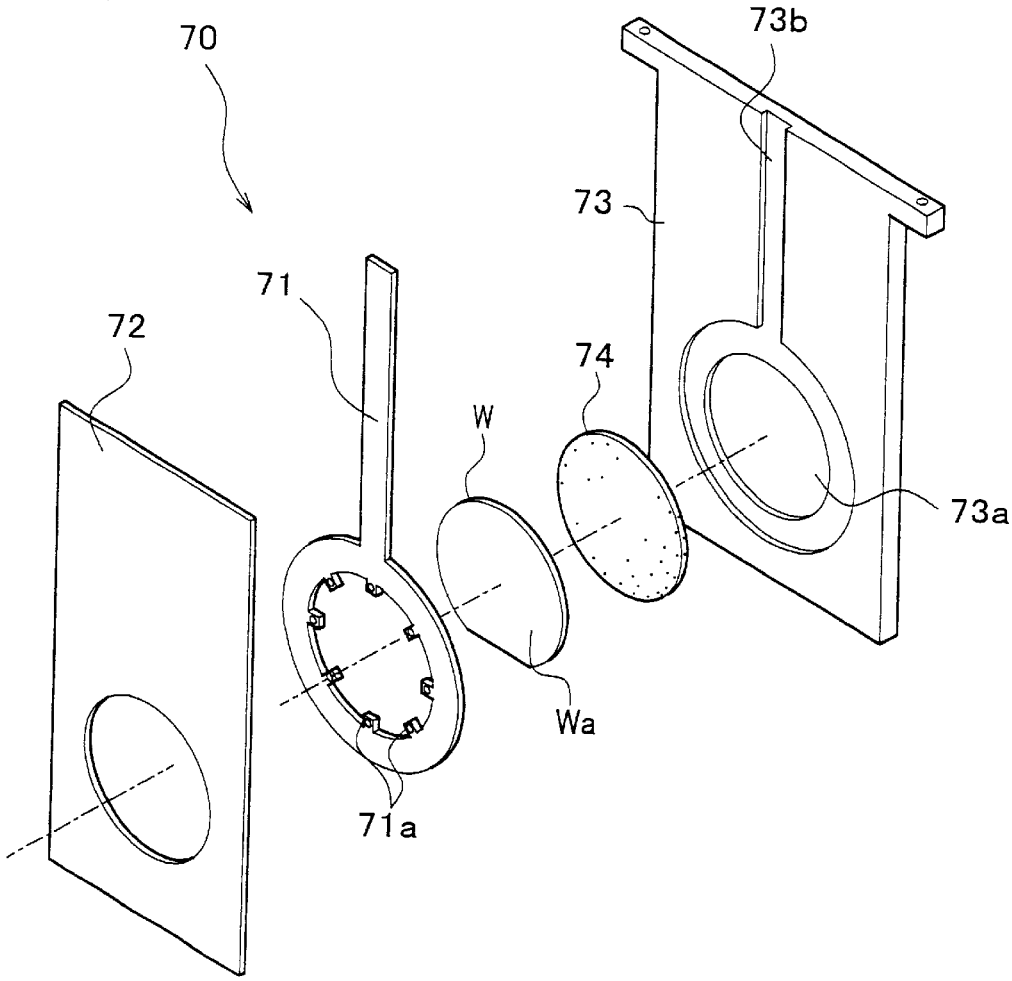
FIG.12 PRIOR ART
FIG. 12 is an exploded perspective view of a conventional cathode cartridge for an electroplating tester.
Figure 13:
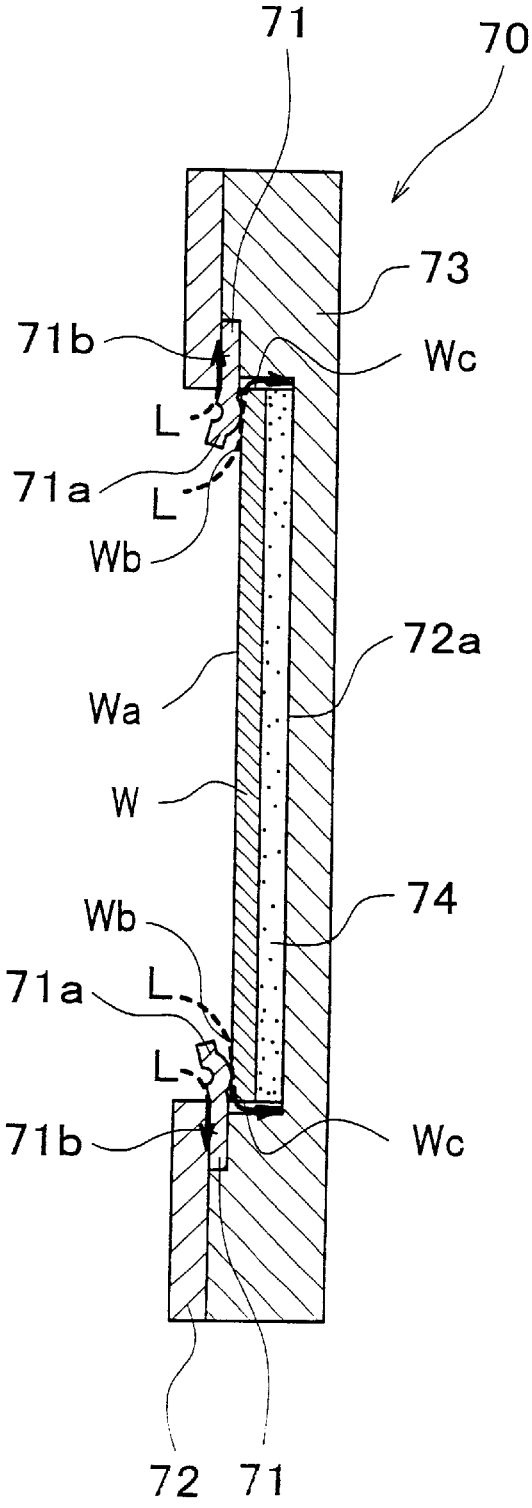
FIG.13 PRIOR ART
FIG. 13 is a cross section of the conventional cathode cartridge.

Next, a description will be given of an electroplating tester to which the cathode cartridge N is applied. FIG. 10 is an external view, in perspective, of the electroplating tester, and FIG. 11 is a cross section of the electroplating tester taken along line D—D of FIG. 10.

As shown in FIG. 10, an electroplating tester 50 includes a plating tank 51, a cathode cartridge (hereinafter referred simply to "cathode") N, an anode conductor (hereinafter referred simply to "anode") 52, a heater 53, a circulating pump, and a power supply. In FIGS. 10 and 11, the circulating pump and the power supply are not illustrated.

The plating tank 51 is a tank made up of a transparent acrylic board, and divided by a partition board 54 into a plating compartment 55 with a larger capacity and a drain compartment 56 with a smaller capacity. The plating compartment 55 is filled with plating solution including a cation such as a copper ion. Plating solution overflowing the plating compartment 55 flows out from the brim of the partition board 54 into the drain compartment 56.

The cathode N is fixed on a wall located opposite to the partition wall in the plating compartment 55 with screws. The cathode N may be fixed on the wall in the plating compartment 55 not only with screws but also using any other means such as a clip. The power-supply connection portion 12 of the cathode conductor 10 projecting from an upper position of the cathode N (see FIG. 9) uses a portion which is not to be immersed in plating solution, to establish connection with the anode of the power supply.

The anode 52 is a thin board made of copper, nickel or the like, and includes a support part 57, which is provided across two upper angles of the rectangular anode 52, as shown in FIG. 10. The support part 57 is used to hook the anode 52 of the electroplating tester 50 on the brim of the plating tank 51, and the thus-hooked anode 52 is positioned opposite to the cathode N. The anode 52 is connected, at an upper position thereof which is not to be immersed in plating solution, with the cathode of the power supply.

The heater 53 is inserted in a heater installation hole 58 that has an opening at the bottom of the plating tank 55 as shown in FIG. 11 and is provided from a side of the plating tank 51 at a predetermined depth in a bottom portion of the plating compartment 55. The heater installation hole 58 has an inlet hermetically sealed with a rubber stopper for the purpose of preventing leakage of plating solution.

The circulating pump (not shown) is connected, as shown in FIG. 10, so as to suck plating solution from a drain outlet 59 provided from a side of the drain compartment 56 in the bottom portion thereof, and to feed plating solution from an influent inlet 60 provided at a side of the plating tank 51 into the plating compartment 55. The plating solution fed from the influent inlet 60 into the plating compartment 55 is spouted at full blast from a jet 61 connected to the influent inlet 60 (see FIG. 11). The jet 61 is provided at the bottom of the plating compartment 55, and more than one such jet 61 is arranged around positions (allowing a spacing of one or two mm) near the surface Wa to be plated of the cathode N and near the surface of the anode 52 opposite to the cathode N.

The power supply (not shown) includes a terminal 62 connected with an upper position of the anode 52, and a terminal 63 connected with the power-supply connection portion 12 of the cathode conductor 10 of the cathode N. The terminal 62 and the upper position of the anode 52 are connected with each other at a location which is not to be immersed in the plating solution. Similarly, the terminal 63 and the power-supply connection portion 12 are connected with each other at a location which is not to be immersed in the plating solution.

The electroplating tester 50 having a construction as described above gives plating onto the surface Wa to be plated of the silicon wafer W (object to be plated) by injecting plating solution into the plating tank 51 up to a level a little below the upper edge of partition board 54, and powering on the circulating pump, thereafter connecting the cathode of the power supply to the terminal 62, and connecting the anode of the power supply to the terminal 63.

During the plating operation, portions of the silicon wafer W other than the rim Wb and side Wc of the surface Wa to be plated, and the protrusions 13 of the cathode conductor 10 are insulated from the plating solution L with the first O-ring 22 and the second O-ring 32, as shown in FIG. 8. In other words, negative portions other than the surface Wa to be plated of the silicon wafer W in the cathode N is isolated from the plating solution. Consequently, no error would occur in areas on the surface to be plated of the silicon wafer W or the object to be plated.

Although the preferred embodiments of the present invention have been described above, the present invention is not limited to the illustrated embodiments, and various modifications and changes may be made in the present invention without departing from the spirit and scope thereof.

As discussed in detail above, the present invention provides a cathode cartridge for an electroplating tester capable of cutting off negative portions other than a surface of an object to be plated.

What is claimed is:

1. A cathode cartridge for an electroplating tester comprising:

a tabular cathode conductor that includes an opening having the same contour as a surface to be plated of an object to be plated as a negative, a plurality of protrusions in contact with a rim of the surface to be plated, and a power-supply connection portion connectible with a power supply at a portion thereof which is not to be immersed in plating solution;

a tabular first insulator that covers one surface to be plated of the object to be plated and includes an opening having the same contour as the surface to be plated, a first sealant fit-in groove which is formed along a circumferential edge of the opening and into which a first sealant is fitted, a cathode conductor fit-in groove which is formed at an outside of the first sealant fit-in groove and into which the cathode conductor is fitted, and a power-supply connection portion slot which is formed contiguously with the cathode conductor fit-in groove and into which the power-supply connection portion is fitted; and a tabular second insulator that covers the other surface reverse to the surface to be plated of the object to be plated and includes an object-to-be-plated fit-in groove into which the object to be plated is fitted, a second sealant fit-in groove which is located at an outside of the object-to-be-plated fit-in groove so as to come in a position outside an inlet of the power-supply connection portion slot when the second insulator is combined with the first insulator and into which a second sealant is fitted, wherein the first insulator and the second insulator are combined together so that the first insulator and the second insulator sandwich the object to be plated and the cathode conductor.

2. A cathode cartridge for an electroplating tester according to claim 1, wherein the first insulator further includes a second insulator fit-in groove which is formed at an outside of the cathode conductor fit-in groove and into which the second insulator is fitted when the first insulator and the second insulator are combined together.

3. A cathode cartridge for an electroplating tester according to claim 1, wherein the first insulator and the second insulator are combined together by fastening up with screws made of plastic.

4. A cathode cartridge for an electroplating tester according to claim 1, wherein a laminar elastic body covering the surface reverse to the surface to be plated of the object to be plated is fitted into the object-to-be-plated fit-in groove.

5. A cathode cartridge for an electroplating tester according to claim 1, wherein the second sealant is in contact with a surface of the first insulator at a location outside the object to be plated.

6. A cathode cartridge for an electroplating tester according to claim 1, wherein an inlet of the power-supply connection portion slot is positioned between the first sealant and the second sealant when the first and second insulators are combined together.

* * * * *